US010913260B2

(12) United States Patent
Iko et al.

(10) Patent No.: US 10,913,260 B2
(45) Date of Patent: Feb. 9, 2021

(54) PRINT CONTROL DEVICE, PRINT CONTROL METHOD, AND STORAGE MEDIUM

(71) Applicant: CANON KABUSHIKI KAISHA, Tokyo (JP)

(72) Inventors: Takumi Iko, Yokohama (JP); Sayaka Harada, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/552,504

(22) Filed: Aug. 27, 2019

(65) Prior Publication Data

US 2020/0070495 A1 Mar. 5, 2020

(30) Foreign Application Priority Data

Aug. 28, 2018 (JP) ..... 2018-159478

(51) Int. Cl.
*B41J 11/66* (2006.01)
*B41F 19/00* (2006.01)

(52) U.S. Cl.
CPC ..... *B41F 19/008* (2013.01); *B41J 11/663* (2013.01)

(58) Field of Classification Search
CPC .. B41J 2/43; B41J 11/46; B41J 11/663; B41F 19/008
See application file for complete search history.

(56) References Cited

U.S. PATENT DOCUMENTS 5,717,958 A 2/1998 Oka et al.
5,867,738 A 2/1999 Oka et al.
5,918,084 A 6/1999 Kitamura
5,949,525 A 9/1999 Nishimura
6,765,687 B2 * 7/2004 Tanaka ..... H04N 1/3873 358/1.13
6,958,820 B1 * 10/2005 Takenaka ..... H04N 1/3875 358/1.12

(Continued)

FOREIGN PATENT DOCUMENTS

JP 09-27897 A 1/1997
JP 2000-094799 A 4/2000

(Continued)

OTHER PUBLICATIONS

European Search Report dated Jan. 16, 2020, in related European Patent Application No. 19190776.5.

*Primary Examiner* — Sharon Polk
(74) *Attorney, Agent, or Firm* — Venable LLP

(57) ABSTRACT

A print control device provides a print control unit that switches, in accordance with a layout of a plurality of images, between printing cutting marks using color inks or transparent ink, and performs printing of images using color inks on a printing paper and then transfers an overcoat onto the printing paper. The print control unit also controls such that in a case of a layout with margin areas for printing the cutting marks on the printing paper, the cutting marks are formed by the color inks, and in a case of a layout with no margin areas for printing the cutting marks, the cutting marks are formed by the overcoat, and forms an overcoat that functions as the cutting marks by changing a pattern of the overcoat in an area in which the cutting mark is to be formed from a pattern of the overcoat in another area.

13 Claims, 7 Drawing Sheets

(56) References Cited

U.S. PATENT DOCUMENTS

| | | | | |
|---|---|---|---|---|
| 2002/0063879 | A1* | 5/2002 | Zeman | G06T 1/0021<br>358/1.14 |
| 2013/0028648 | A1* | 1/2013 | Dufort | G06F 3/1264<br>400/621 |

FOREIGN PATENT DOCUMENTS

| | | | |
|---|---|---|---|
| JP | 2000-258849 | A | 9/2000 |
| JP | 2002-160410 | A | 6/2002 |
| JP | 2005-125536 | A | 5/2005 |
| JP | 2006-212997 | A | 8/2006 |
| JP | 2010-195021 | A | 9/2010 |
| JP | 2012-135899 | A | 7/2012 |
| JP | 2012-232530 | A | 11/2012 |
| JP | 2017-118429 | A | 6/2017 |
| JP | 2018-008366 | A | 1/2018 |

* cited by examiner

PRINT CONTROL DEVICE, PRINT CONTROL METHOD, AND STORAGE MEDIUM

BACKGROUND OF THE INVENTION

Field of the Invention

The present invention relates to a print control device and a print control method that have a function of printing cutting marks on a printing paper.

Description of the Related Art

There is a usage in which a plurality of print target images are printed on a single piece of printing paper and cut off to be used after the printing is performed, and for such a usage, concurrent printing of cutting marks that give an indication of the cutting has been traditionally performed.

Japanese Patent Laid-Open No. 9-27897 describes a certification photograph printing apparatus that performs printing of four portrait images, taken for the same person, with cutting marks.

Japanese Patent Laid-Open No. 2012-232530 describes a printing apparatus that provides non-transfer areas of overcoat as cutting marks (cutting reference lines) of a certification photograph.

Japanese Patent Laid-Open No. 2000-258849 describes a certification photograph printing apparatus configured to perform printing of cutting marks at a paper end of a margin area portion around an image, on a certification photograph paper.

However, according to the related art disclosed in Japanese Patent Laid-Open No. 9-27897, the positions of the cutting marks are determined with respect to the print target image (portrait image), where the size of the printing paper is not particularly taken into consideration. This is because, in Japanese Patent Laid-Open No. 9-27897, the size of the print target image as well as the size of the printing paper are constant.

Meanwhile, considering typical photo printing, the size of the print target image is not constant, and moreover, there is a circumstance in which the size of the printing paper is also not constant. In such a circumstance, provided that the technology described in Japanese Patent Laid-Open No. 9-27897 is introduced, there is a likelihood that the cutting marks run off the printing paper, or overlap with an adjacent target image. In order to avoid the above situation, it is necessary to reduce the print target images to be printed on a single piece of printing paper to reserve an area where cutting marks are printed, thus resulting in lower productivity.

Further, according to the related art disclosed in Japanese Patent Laid-Open No. 2012-232530, cutting marks are printed by a method providing non-transfer areas of overcoat with respect to the print target image (certification photograph), where the visibility of the cutting marks is not particularly taken into consideration. The cutting marks transferred by the method of providing non-transfer areas of overcoat do not become visible unless the printed material is tilted, and the visibility is lower as compared to the cutting marks printed by an ordinary method.

Further, the related art disclosed in Japanese Patent Laid-Open No. 2000-258849 is of service when cutting of a certification photograph is performed with a cutting machine or cutter, however, in a case of a layout in which margin area portion is not provided in a printing paper, cutting marks cannot be printed. In this case, when a layout is selected in which margin area portions are provided, then the print target images are reduced, leading to lower productivity as in the above-described Japanese Patent Laid-Open No. 9-27897.

SUMMARY OF THE INVENTION

The present invention has been made under the above-described situation, and provides a printing apparatus that is hardly affected by the size of the image, the size of the printing paper, and the layout of the images when forming cutting marks on a printed material.

According to a first aspect of the present invention, there is provided a print control device comprising at least one processor or circuit configured to function as the following unit: a print control unit configured to control, when laying out and performing printing of a plurality of images on a single piece of printing paper, printing of cutting marks serving as an aid for cutting off the plurality of images from the printing paper, wherein the print control unit is configured to switch, in accordance with a layout of the plurality of images, whether the cutting marks are to be printed using color inks, or to be printed using transparent ink.

According to a second aspect of the present invention, there is provided a print control method comprising print controlling, when laying out and performing printing of a plurality of images on a single piece of printing paper in a printing apparatus, printing of cutting marks serving as an aid for cutting off the plurality of images from the printing paper, wherein in the print controlling, in accordance with the layout of the plurality of images, whether the cutting marks are to be printed using color inks, or to be printed using transparent ink, is switched.

Further features of the present invention will become apparent from the following description of exemplary embodiments with reference to the attached drawings.

DESCRIPTION OF THE EMBODIMENTS

Embodiments of the present invention are described below with reference to the accompanying drawings.

First Embodiment

Figure 1:
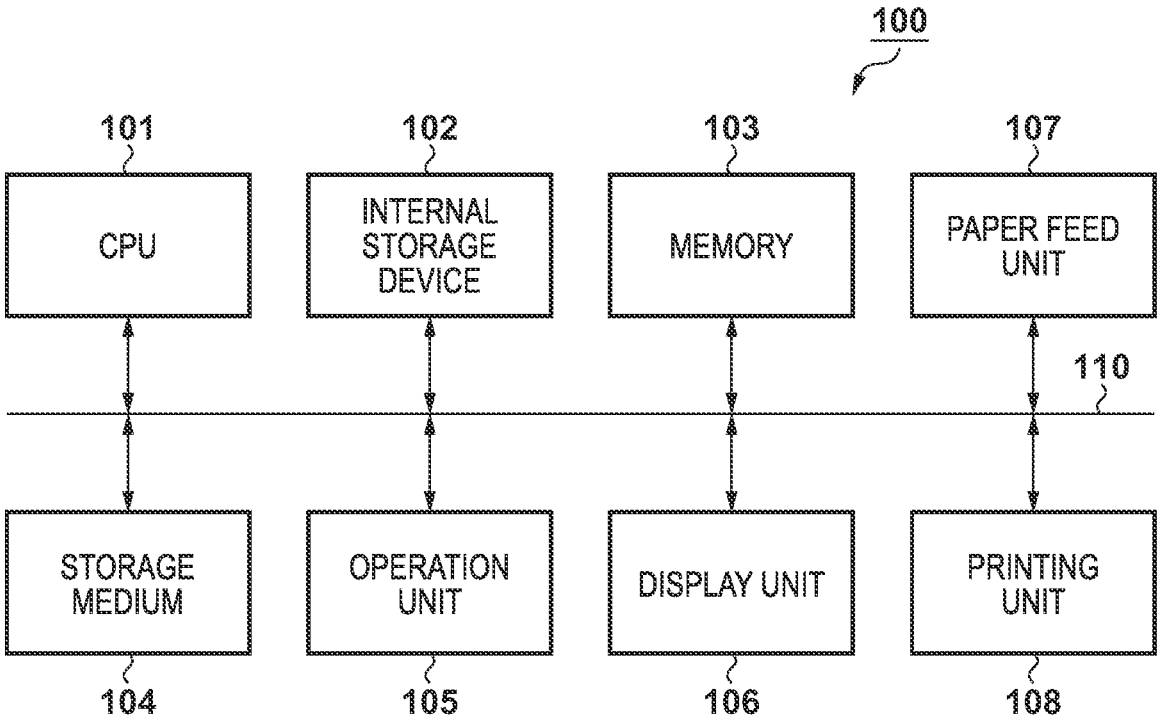
FIG. 1 is a block diagram schematically illustrating a configuration of a printing apparatus according to a first embodiment of the present invention.

FIG. 1 is a block diagram schematically illustrating a configuration of a printing apparatus according to a first embodiment of the present invention. The printing apparatus according to the first embodiment is, for example, a heat-transfer type printing apparatus.

In FIG. 1, a printing apparatus 100 is configured by connecting a CPU 101, an internal storage device 102, a memory 103, a storage medium 104, an operation unit 105, a display unit 106, a paper feed unit 107, and a printing unit 108 to one another via an internal bus 110. Each of the units connected to the internal bus 110 can exchange data with one another via the internal bus 110.

Data such as various programs for the operation of the CPU 101 is stored in the internal storage device 102. The CPU 101 is configured to control each of the units of the printing apparatus 100 while using the memory 103 as a working memory, in accordance with the programs stored in the internal storage device 102. The storage medium 104 stores image data of images to be printed, and the like. The storage medium 104 may be made removable from the printing apparatus 100.

The operation unit 105 is used for receiving an instruction of the user to the printing apparatus 100. The display unit 106 is configured to display images of image data of images to be printed, and to display a menu and the like for interactive operations. Note that a configuration may be employed in which means to correspond to the display unit 106 is externally connected to the printing apparatus 100, where in this case, the printing apparatus 100 is required to be provided with a display control means for controlling the display of the external display means.

The paper feed unit 107 stores printing paper and feeds a printing paper to the printing unit 108 on the basis of the control of the CPU 101. The printing unit 108 is configured to perform printing of designated images onto the printing paper fed from the paper feed unit 107, on the basis of the control of the CPU 101. The printing unit 108 is configured to perform printing of designated images onto the printing paper using a plurality of color inks, and to then transfer an overcoat onto the printing paper on which the images have been printed. The printing unit 108 according to the first embodiment is to sequentially transfer, using a heat-transfer scheme, a plurality of color inks and an overcoat stored in non-illustrated ink cassettes onto the printing paper, to thereby perform printing of images. However, another printing scheme may be used for performing printing of images using color inks, and printing of an overcoat using a transparent ink.

Figure 2:
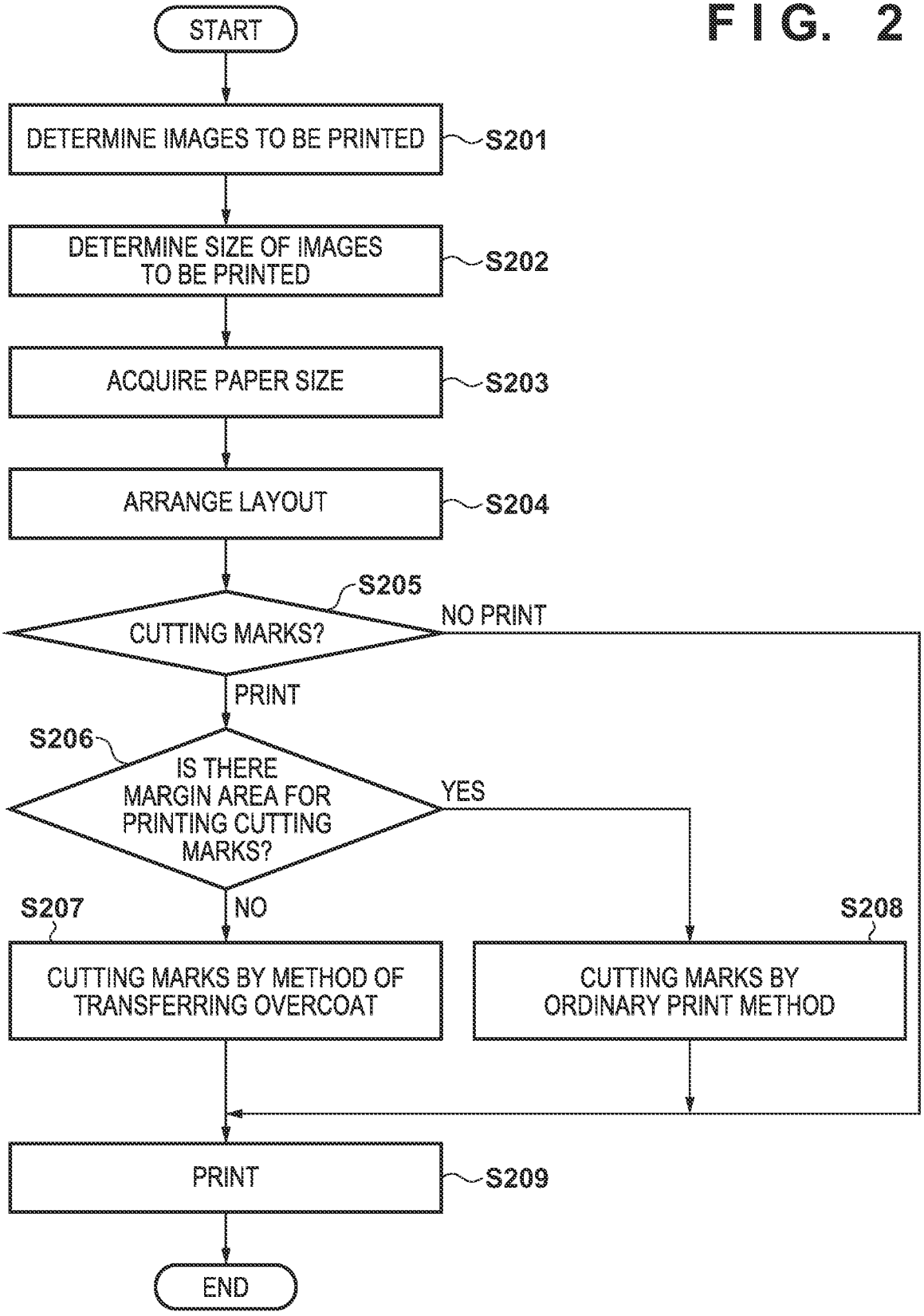
FIG. 2 is a flowchart illustrating an operation of print processing according to a first embodiment.
Figure 3A:
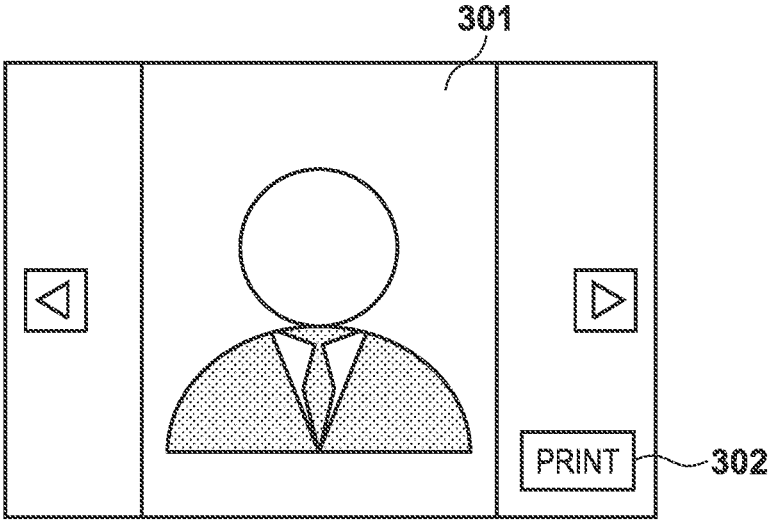
FIGS. 3A and 3B are diagrams illustrating examples of a display screen for selection of images, image sizes, and a presence or absence of cutting marks according to a first embodiment.
Figure 3B:
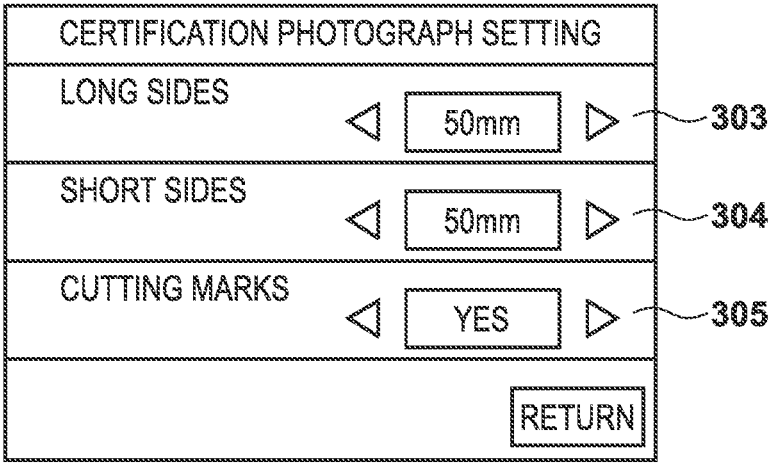
Figure 4A:
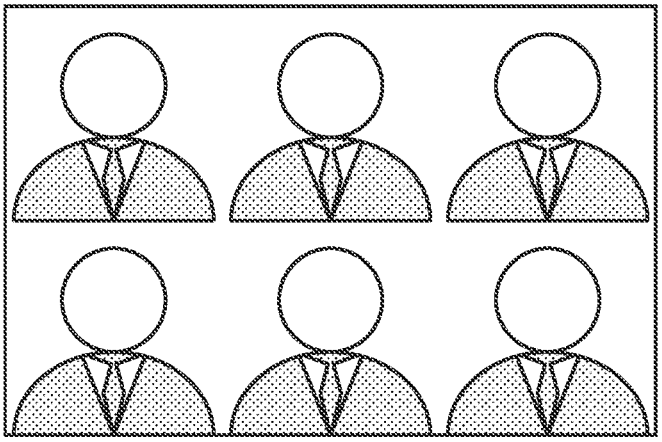
FIGS. 4A and 4B are diagrams illustrating arrangement examples of images according to a first embodiment.
Figure 4B:
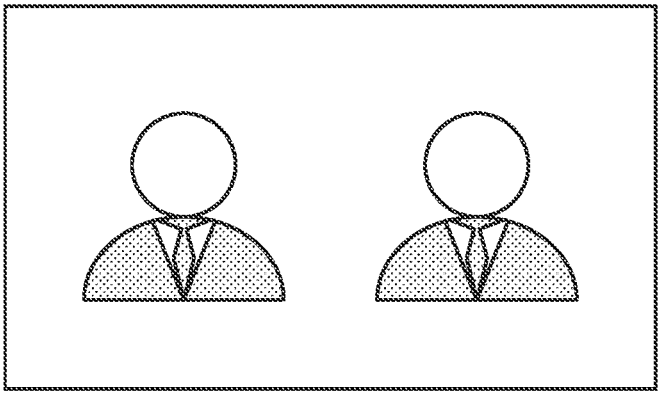
Figure 5A:
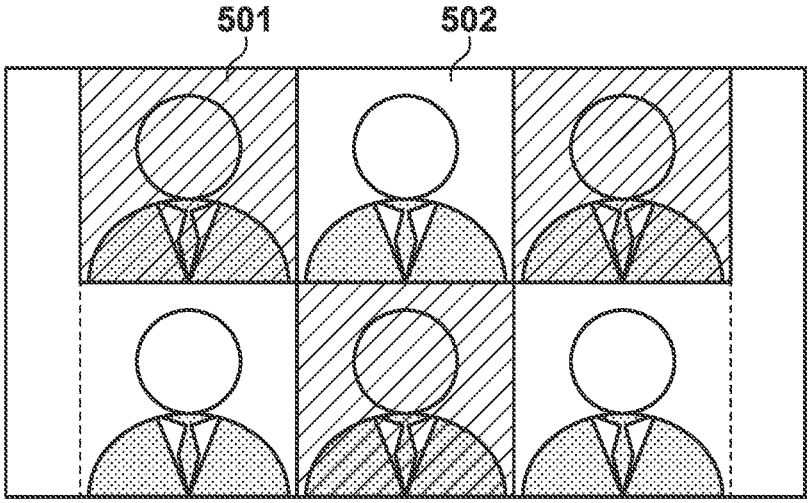
FIGS. 5A to 5C are diagrams illustrating examples of cutting marks formed according to a first embodiment.
Figure 5B:
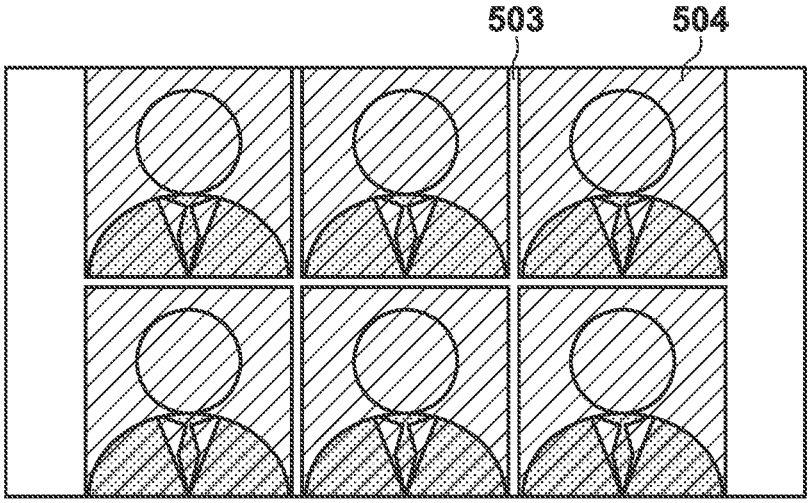
Figure 5C:
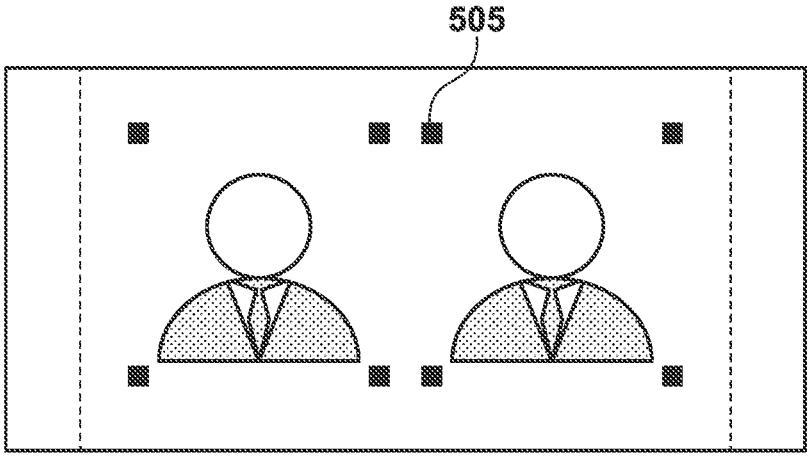

An operation of print processing of the printing apparatus 100 will be described with reference to FIG. 2, FIGS. 3A and 3B, FIGS. 4A and 4B, and FIGS. 5A to 5C. FIG. 2 is a flowchart illustrating the operation of print processing of the printing apparatus 100. FIGS. 3A and 3B are diagrams illustrating examples of a screen displayed on the display unit 106 of the printing apparatus 100. FIGS. 4A and 4B are diagrams illustrating arrangement examples of images printed on a printing paper. FIGS. 5A to 5C are diagrams illustrating examples of cutting marks printed or formed on the printing paper.

First, in step S201, the CPU 101 determines one or more images to be printed among the images stored in the storage medium 104, on the basis of an instruction or selection by a user. FIG. 3A illustrates an example of a display screen of the display unit 106 when selecting an image to be printed.

In the example illustrated in FIG. 3A, the display unit 106 is displaying an image 301 stored in the storage medium 104. In this case, the user can cause another image of the storage medium 104 to be displayed by operating the operation unit 105. The user can instruct the CPU 101 to perform printing (or selection as the premise thereof) of an image being displayed by operating, via the operation unit 105, a print button 302 displayed on the screen. Although not illustrated, the number of prints may be designated on the screen, and a plurality of images may be selected or set for the print target.

In step S202, the CPU 101 determines the size of the images to be printed, on the basis of an instruction or selection by the user. FIG. 3B illustrates an example of a setup screen for a certification photograph of the printing apparatus 100.

In the example illustrated in FIG. 3B, the dimensions of long sides 303 and short sides 304 can be set as the settings of the certification photograph, which are to be applied. As the dimension of the long sides 303, "50 mm" is set, and as the dimension of the short sides 304, "50 mm" is set, as the initial values. The user can select and set the dimensions of the long sides 303 and the short sides 304 by operating the operation unit 105.

In step S203, the CPU 101 acquires the size of the printing paper to be actually used for the printing from the paper feed unit 107 (printing paper size). In a case where printing papers having different sizes can be fed from the paper feed unit 107, the CPU 101 may display candidates for the size of the printing paper on the display unit 106 and allow the user to make a selection. The selection of the size of the printing paper may be done beforehand, or may be done each time printing is performed.

In step S204, the CPU 101 causes images of the number arrangeable on a single piece of printing paper to be arranged in a predetermined layout, on the basis of the size of the images which has been set in step S202 and the size of the printing paper which has been acquired in step S203. FIG. 4 illustrates the arrangement examples of images.

In the example illustrated in FIG. 4A, images with the size, to be printed, of 50 mm×50 mm are arranged on a printing paper having a size of 150 mm×100 mm Three images in the long side direction and two images in the short side direction can be arranged on the printing paper, where six images can be arranged on a single piece of printing paper.

In the example illustrated in FIG. 4B, images with the size, to be printed, of 50 mm×50 mm are arranged on a printing paper having a size of 120 mm×90 mm Two images in the long side direction and one image in the short side direction can be arranged on the printing paper, where two images can be arranged on a single piece of printing paper.

In step S205, the CPU 101 determines whether to print cutting marks, on the basis of an instruction or selection by the user.

FIG. 3B illustrates an example of a setup screen for a certification photograph. In the example illustrated in FIG. 3B, the user can instruct the CPU 101 whether to print the selected images with or without cutting marks. In this example, "YES" is set as the initial value for a cutting mark 305. The user is allowed to set "None" (no cutting mark is to be printed) by operating the operation unit 105. Note that the cutting mark represents a mark for assisting the user to cut off the printed images.

In step S206, the CPU 101 determines if there is a margin area for printing cutting marks. If there is no margin area for printing cutting marks, the CPU 101 causes the process to proceed to step S207. If there is a margin area for printing cutting marks, the CPU 101 causes the process to proceed to step S208. Note that, in the process of the step S206, a one-time determination may be performed on a single piece of printing paper, or a determination may be performed on each of the images to be arranged. Alternatively, when arranging images of the number arrangeable on a single piece of printing paper in step S204, the result of the determinations, which have been performed beforehand for all the arrangements, may be acquired.

In the example illustrated in FIG. 4A, images with the size, to be printed, of 50 mm×50 mm are arranged on a printing paper having a size of 150 mm×100 mm. In this layout, the margin from the paper end to the image end and between the images is 0 mm, and thus it is determined that there is no margin area for printing cutting marks.

In the example illustrated in FIG. 4B, images with the size, to be printed, of 50×50 mm are arranged on a printing paper having a size of 120 mm×90 mm. In this layout, there is a margin area of 20 mm in the long side direction of the printing paper, and a margin area of 40 mm in the short side direction, and thus it is determined that there is a margin area for printing cutting marks.

In step S207, the CPU 101 generates print data (gradation data) of overcoat so as to form cutting marks with varying methods, for each of the areas, of transferring the overcoat to be formed on the images. At this time, color inks are not used for forming the cutting marks. FIGS. 5A and 5B illustrate examples of cutting marks formed on the printing paper.

In the example illustrated in FIG. 5A, a printing paper having a size of 150 mm×100 mm is printed with images having the size, to be printed, of 50 mm×50 mm, and the methods of transferring an overcoat are varied for each of the areas to thus form the cutting marks. An image area 501 has a specific pattern (for example, a checkered pattern) as the gradation of overcoat, while an image area 502 adjacent to the image area 501 has a single gradation as the gradation of overcoat.

In the example illustrated in FIG. 5B, a printing paper having a size of 150 mm×100 mm is printed with images having the size, to be printed, of 50 mm×50 mm, and the methods of transferring an overcoat are varied for each of the areas to thus form the cutting marks. A cutting line area 503 has a single gradation as the gradation of overcoat, while the other areas 504 corresponding to the images have a specific pattern as the gradation of overcoat. Note that, as a method of varying methods of transferring an overcoat for each of the areas to thus form cutting marks, the cutting line area 503 is made to be a non-transfer area of overcoat, while the other areas 504 may be made to have a single gradation as the gradation of overcoat. Further, the cutting line area 503 may have a specific pattern as the gradation of overcoat, while the other areas 504 may have another specific pattern as the gradation of overcoat. Moreover, the cutting line area 503 may have a specific pattern as the gradation of overcoat, while the other areas 504 may have a single gradation as the gradation of overcoat. The method of varying methods of transferring an overcoat for each of the areas to thus form cutting marks is not limited to the above methods, and may be any combination of these methods.

In step S208, the CPU 101 adds cutting marks to images laid out in S204 to perform printing of the cutting marks by an ordinary print method, that is, by using color inks. At this time, the overcoat is used with overcoat print data that includes no typical cutting marks because cutting marks are not printed. FIG. 5C illustrates an example of cutting marks printed on a printing paper.

In the example illustrated in FIG. 5C, images having the size, to be printed, of 50 mm×50 mm are printed on a printing paper having a size of 120 mm×90 mm, where cutting marks 505 are printed by an ordinary print method. Although the cutting marks 505 are arranged at the four corners of the image to be printed and then caused to be printed, the shapes and print positions of cutting marks are not limited to this, and cutting marks may be linear or a dashed line, or a plurality of dots. However, the cutting marks are printed outside of the image area of the images to be printed.

In step S209, the CPU 101 instructs the paper feed unit 107 to feed a printing paper and gives an instruction to the printing image unit 108, to thus cause printing to be performed onto the printing paper (print control). For the printing using color inks, in a case where it is determined to form cutting marks using overcoat in S207, the CPU 101 converts the images laid out in S204 into print data (gradation data of colors) and gives an instruction to perform printing based on the print data. Further, in a case where it is determined in S208 to form cutting marks using color inks, the CPU 101 converts the laid-out images to which cutting marks are added in S208 into print data (gradation data of colors), and gives an instruction to perform printing based on the print data. For the printing of overcoat after the use of the color inks, in a case where it is determined to form cutting marks using overcoat in S207, the CPU 101 gives an instruction based on print data of overcoat (gradation data) including cutting marks, which have been generated in S207. While, in a case where it is determined in S208 to form cutting marks using color inks, the CPU 101 gives an instruction based on print data of overcoat (gradation data) that include no typical cutting marks.

In the arrangement example illustrated in FIG. 4A, due to the lack of margin area around the image area of the images to be printed, cutting marks cannot be printed by an ordinary method. In contrast, according to the process of the first embodiment, as illustrated in FIGS. 5A and 5B, by varying methods of transferring an overcoat for each of the areas, cutting marks can be formed although the visibility is lowered. That is, according to the first embodiment, the method of forming cutting marks is switched between the case where there is a margin area for printing cutting marks on the printing paper and the case where there is no margin area for printing cutting marks, thus making it possible to form cutting marks in either case.

Note that, although in the above-described embodiment, an integrated printing apparatus has been described as an example, the present invention is not limited to this embodiment. The present invention may be achieved by means of a system in which a printing apparatus including the paper feed unit 107 or the printing unit 108 is coupled to a control device configured to perform a control of determining a selection or layout of images and a control of operating the printing apparatus. In this case, the printing apparatus performs the print processing in S209, and the control device performs determination of a selection or arrangement of images in S201 to S208, for example.

Second Embodiment

In the above-described first embodiment, in a case where there is no margin area for printing cutting marks around an image to be printed, cutting marks are formed by varying methods of transferring an overcoat for each of the areas.

Here, the printing apparatus according to a second embodiment is a heat-transfer type printing apparatus similar to the first embodiment. The heat-transfer type printing apparatus is configured to perform printing on a recording paper having a cutting line such as a perforation for separating the print range from a non-print target (so-called tab area). The heat-transfer type printing apparatus, which grips and transports a paper to perform printing thereon, needs tab areas on which printing is not to be performed. In the second embodiment, tab areas that inevitably occur in the heat-transfer printer are utilized, and cutting marks are formed in these tab areas.

The block configuration of the printing apparatus according to the second embodiment is the same as the configuration of the first embodiment illustrated in FIG. 1, and thus duplicate descriptions thereof will be omitted.

Figure 6:
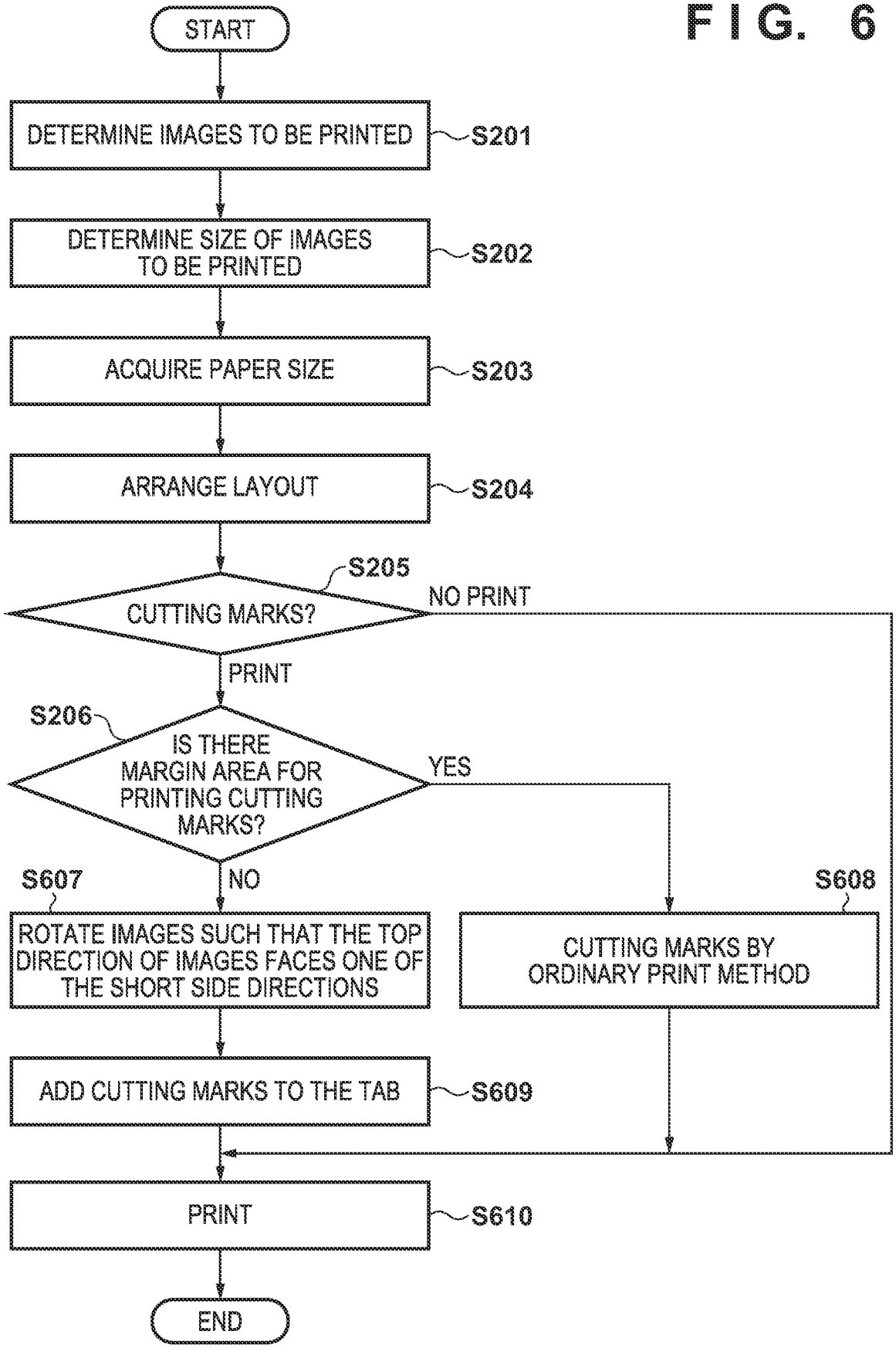
FIG. 6 is a flowchart illustrating an operation of print processing according to a second embodiment.

FIG. 6 is a flowchart illustrating an operation of print processing of the printing apparatus 100 according to the second embodiment. The processes of steps S201 to S205 in FIG. 6 are the same as the processes of steps S201 to S205 in FIG. 2, which illustrate the first embodiment, and thus duplicate descriptions thereof will be omitted.

In step S206, the CPU 101 determines if there is a margin area for printing cutting marks on the printing paper. If there is no margin area for printing cutting marks, the CPU 101 causes the process to proceed to step S607. If there is a margin area for printing cutting marks, the CPU 101 causes the process to proceed to step S608.

In step S607, for the images laid out in S204, the CPU 101 causes all the images to rotate such that the top direction of the images faces one of the short side directions of the printing paper. In step S609, the CPU 101 adds cutting marks to the tab areas on the printing paper of the laid-out images for which the images have been rotated in S607.

Figure 7A:
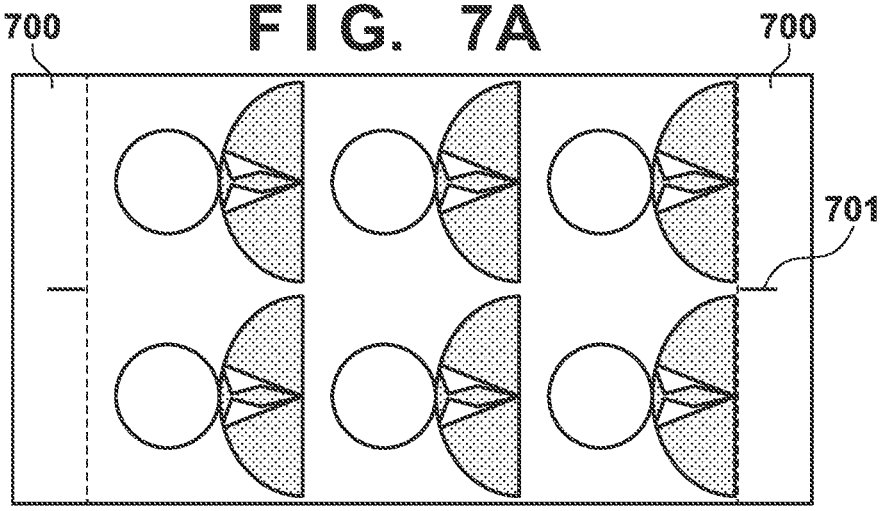
FIGS. 7A to 7C are diagrams illustrating examples of cutting marks formed according to a second embodiment.

FIG. 7A illustrates an example of printing of cutting marks in tab areas 700 of the printing paper. The rotation of images in step S607 is due to the necessity of causing the cutting to be performed utilizing print marks because there are no marks for the cutting at the vertical line in cutting the certification photograph, as well as due to the easiness in cutting the paper because the demarcation of images is distinguishable, without the cutting marks, in the horizontal direction. Cutting marks 701 are printed at the central portions between the images in the tab areas 700.

Figure 7B:
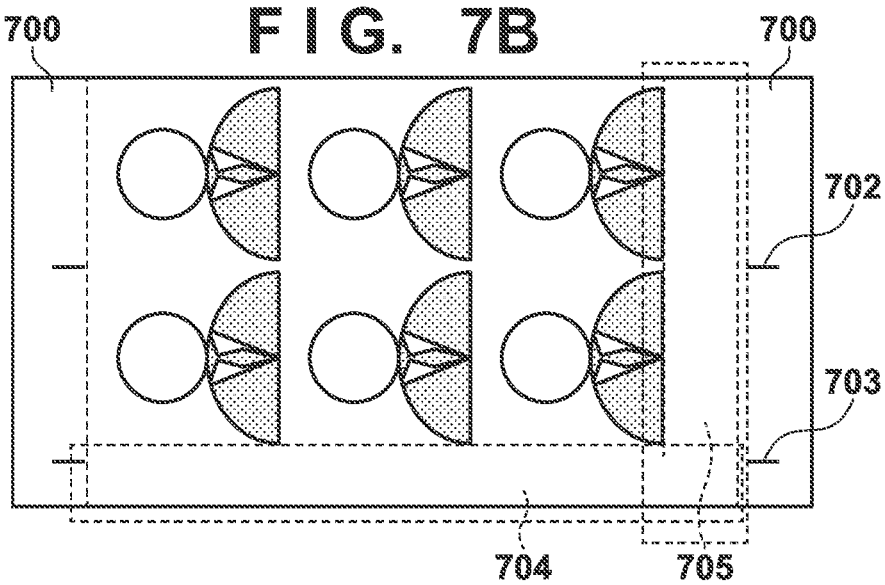

FIG. 7B illustrates an example of a pattern in which margin areas occur when images are laid out on the printing paper. In this case, the images are brought close to one of the long side directions to form a margin area 704, and cutting marks 702 and 703 are caused to be printed at two locations in the tab areas 700. In a case where a margin area occurs in the long side direction, the images are brought close, in the vertical direction of the images, toward one of the tab area to arrange a layout so as to form a margin area 705, to thereby eliminate the need for the cutting marks in the horizontal direction of the images.

Figure 7C:
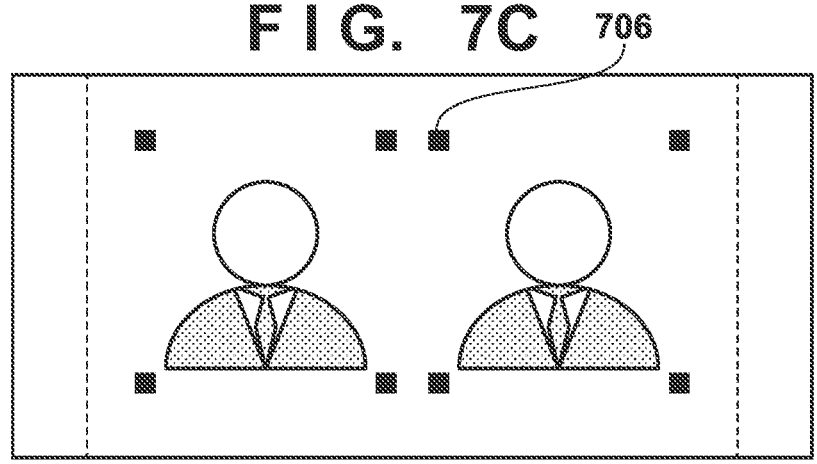

In step S608, the CPU 101, which performs printing of cutting marks by an ordinary print method, adds cutting marks to the images laid out in S204. FIG. 7C illustrates an example of cutting marks printed on a printing paper.

In the example illustrated in FIG. 7C, images having the size, to be printed, of 50 mm×50 mm are printed on a printing paper having a size of 120 mm×90 mm, where cutting marks 505 are printed by an ordinary print method. Although the cutting marks 505 are arranged at the four corners of the image to be printed and then caused to be printed, the shapes and print positions of cutting marks are not limited to this, and cutting marks may be linear or a dashed line, or a plurality of dots. However, the cutting marks are printed outside of the image area of the images to be printed.

In step S610, the CPU 101 instructs the paper feed unit 107 to feed a printing paper and instructs the printing unit 108 to perform printing based on the print data onto the printing paper. For the color inks, the CPU 101 generates print data (gradation data of colors) on the basis of the laid-out images generated in S204, and instructs performing printing on the basis of the generated print data. However, in a case where the images are rotated or the cutting marks are added in S607, S608, and S609, the CPU 101 generates print data on the basis of the laid-out images for which the images have been rotated or to which cutting marks are added, and instructs performing printing on the basis of the generated print data. The CPU 101 then instructs performing printing of overcoat on the basis of print data of overcoat that include no typical cutting marks.

In the arrangement example illustrated in FIG. 4A, due to the lack of margin area around the image area of the images to be printed, cutting marks cannot be printed by an ordinary method. In contrast, according to the process of the second embodiment, as illustrated in FIGS. 7A and 7B, print marks can be printed by using the tab areas on the printing paper.

Note that, in a case where there is no margin area for printing cutting marks on the printing paper, a selection may be made, as described below, between the forming of cutting marks by varying schemes of transferring an overcoat for each of the areas as in the first embodiment, and the printing of cutting marks in the tab areas. For example, a scheme may be selected, in accordance with the size patterns of a certification photograph, such that, in a case where there are a plurality of size patterns of a certification photograph laid out on a printing paper, the scheme of transferring an overcoat is employed, while in a case where there are solely size patterns of the same type, printing of cutting marks in the tab areas is employed.

Further, in step S607, the method of determination for the rotation of the images may include a method of causing the background hue of respective adjacent images to be different, or a method of determining the orientation of the images by performing face detection with an image recognition, to thus determine the top and bottom to perform a layout.

In addition, in a case where it is determined in step S206 that no gap is provided between the images, a method may be employed in which the cutting position of the image is determined at the chest position in the image and the cutting marks are not caused to be printed, by arranging the respective adjacent images so that the images may not be equally oriented. For example, in a case of arranging three images on the long side direction and two images on the short side direction, a method may be employed in which the images on both short sides are arranged with one of the long side directions facing upwards, while the two central images are arranged with the different long side directions facing upward.

Other Embodiments

Embodiment(s) of the present invention can also be realized by a computer of a system or apparatus that reads out and executes computer executable instructions (e.g., one or more programs) recorded on a storage medium (which may also be referred to more fully as anon-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-159478, filed Aug. 28, 2018 which is hereby incorporated by reference herein in its entirety.

What is claimed is:

1. A print control device comprising:

at least one processor or circuit configured to function as:

a print control unit configured to control, when laying out and performing printing of a plurality of images on a single piece of printing paper, printing of cutting marks serving as an aid for cutting off the plurality of images from the printing paper, wherein the print control unit is configured to switch, in accordance with a layout of the plurality of images, between printing the cutting marks using color inks or transparent ink, the print control unit is configured to perform printing of images using color inks on a printing paper, and to then transfer an overcoat onto the printing paper on which the images have been printed, wherein the print control unit is configured to control such that in a case of a layout with margin areas for printing the cutting marks on the printing paper, the cutting marks are formed by the color inks, and in a case of a layout with no margin areas for printing the cutting marks, the cutting marks are formed by the overcoat, and wherein the print control unit is configured to form an overcoat that functions as the cutting marks by changing a pattern of the overcoat in an area in which the cutting mark is to be formed from a pattern of the overcoat in another area.

2. The print control device according to claim 1, wherein the print control unit, in a case of a layout with no margin areas for printing the cutting marks on the printing paper, is configured to form the overcoat that functions as the cutting marks by changing a gradation pattern of the overcoat in the area in which the cutting mark is to be formed from a pattern of the overcoat in another area.

3. The print control device according to claim 2, wherein the print control unit is configured to form the overcoat in the area in which the cutting mark is to be formed to have a gradation pattern of a specific pattern and form a pattern of the overcoat in another area to have a single gradation.

4. The print control device according to claim 1, wherein the at least one processor or circuit is configured to further function as:

a printing unit configured to print images onto the printing paper.

5. A print control device comprising:

at least one processor or circuit configured to function as:

a print control unit configured to control, when laying out and performing printing of a plurality of images on a single piece of printing paper, printing of cutting marks serving as an aid for cutting off the plurality of images from the printing paper, wherein the print control unit is configured to switch, in accordance with a layout of the plurality of images, between printing the cutting marks using color inks or using transparent ink, and wherein the print control unit is configured to perform printing of the cutting marks in tab areas which are areas in which the images are not printed on the printing paper in a case of a layout with no margin areas for printing the cutting marks on the printing paper.

6. The print control device according to claim 5, wherein the print control unit is configured to perform printing of the cutting marks solely in the tab areas on the printing paper.

7. The print control device according to claim 5, wherein the print control unit is configured to layout the plurality of images such that an upper direction of the plurality of images faces toward one of the tab areas on the printing paper, and to arrange the plurality of images to be close to one another such that no gap is created in an upper direction of the images.

8. The print control device according to claim 5, wherein the print control unit is configured to, in a case where there is a gap in a long side direction when the plurality of images are laid out, arrange the plurality of images to be close to one another and close to one of the long side directions on the printing paper, and to perform printing of a plurality of the cutting marks in the tab areas on the printing paper.

9. The print control device according to claim 5, wherein the print control unit is configured to perform printing of the cutting marks solely in a case where backgrounds of the plurality of images are of an identical hue.

10. A print control method comprising:

print controlling, when laying out and performing printing of a plurality of images on a single piece of printing paper, printing of cutting marks serving as an aid for cutting off the plurality of images from the printing paper, wherein the print controlling switches, in accordance with a layout of the plurality of images, between printing the cutting marks using color inks or using transparent ink, wherein the print controlling performs printing of images using color inks on a printing paper and then transfers an overcoat onto the printing paper on which the images have been printed, wherein the print controlling controls such that in a case of a layout with margin areas for printing the cutting marks on the printing paper, the cutting marks are formed by the color inks, and in a case of a layout with no margin areas for printing the cutting marks, the cutting marks are formed by the overcoat, and wherein the print controlling forms an overcoat that functions as the cutting marks by changing a pattern of the overcoat in an area in which the cutting mark is to be formed from a pattern of the overcoat in another area.

11. A non-transitory computer readable storage medium storing a program for causing a computer to execute a print control method comprising:

print controlling, when laying out and performing printing of a plurality of images on a single piece of printing paper, printing of cutting marks serving as an aid for cutting off the plurality of images from the printing paper, wherein the print controlling switches, in accordance with a layout of the plurality of images, between printing the cutting marks using color inks or using transparent ink, wherein the print controlling performs printing of images using color inks on a printing paper and then transfers an overcoat onto the printing paper on which the images have been printed, wherein the print controlling controls such that in a case of a layout with margin areas for printing the cutting marks on the printing paper, the cutting marks are formed by the color inks, and in a case of a layout with no margin areas for printing the cutting marks, the cutting marks are formed by the overcoat, and wherein the print controlling forms an overcoat that functions as the cutting marks by changing a pattern of the overcoat in an area in which the cutting mark is to be formed from a pattern of the overcoat in another area.

12. A print control method comprising:

print controlling, when laying out and performing printing of a plurality of images on a single piece of printing paper, printing of cutting marks serving as an aid for cutting off the plurality of images from the printing paper, wherein the print controlling switches, in accordance with a layout of the plurality of images, between printing the cutting marks using color inks or using transparent ink, and wherein the print controlling performs printing of the cutting marks in tab areas which are areas in which the images are not printed on the printing paper in a case of a layout with no margin areas for printing the cutting marks on the printing paper.

13. A non-transitory computer readable storage medium storing a program for causing a computer to execute a print control method comprising:

print controlling, when laying out and performing printing of a plurality of images on a single piece of printing paper, printing of cutting marks serving as an aid for cutting off the plurality of images from the printing paper, wherein the print controlling switches, in accordance with a layout of the plurality of images, between printing the cutting marks using color inks or using transparent ink, and wherein the print controlling performs printing of the cutting marks in tab areas which are areas in which the images are not printed on the printing paper in a case of a layout with no margin areas for printing the cutting marks on the printing paper.

* * * * *